US005603201A

United States Patent [19]

LaFata et al.

[11] Patent Number: 5,603,201

[45] Date of Patent: Feb. 18, 1997

[54] PACKAGING SYSTEM

[76] Inventors: John E. LaFata, 2129 Ocean Dr., Oxnard, Calif. 93035; Brett D. Ritter, 844 San Pedro, #1, Ventura, Calif. 93001; Rodney L. Cameron, 124 Fillmore Ave., Oxnard, Calif. 93035

[21] Appl. No.: 192,180

[22] Filed: Feb. 4, 1994

[51] Int. Cl.[6] ..... B65B 47/00

[52] U.S. Cl. ..... 53/453; 53/471; 53/485; 206/471

[58] Field of Search ..... 53/473, 471, 453, 53/456, 477, 478, 485, 487; 206/471

[56] References Cited

U.S. PATENT DOCUMENTS

| | | | |
|---|---|---|---|
| 3,347,733 | 10/1967 | Elver | 53/477 |
| 3,399,763 | 9/1968 | Stone | 53/453 |
| 3,406,492 | 10/1968 | Ludwig | 53/478 |
| 3,430,411 | 3/1969 | Ollier | 53/453 |
| 3,864,892 | 2/1975 | Molvar | 53/478 |
| 3,997,052 | 12/1976 | Eddy et al. | 53/453 |
| 4,047,358 | 9/1977 | Heffernan et al. | 53/477 |
| 4,495,749 | 1/1985 | Faller | 53/478 |
| 4,777,780 | 10/1988 | Holzwarth | 53/471 |

*Primary Examiner*—John Sipos
*Assistant Examiner*—Ed Tolan
*Attorney, Agent, or Firm*—J. Robert Cassidy, P.S.

[57] ABSTRACT

A blister package, method for forming the same, and backing sheet for use therewith, wherein the package includes: i) a planar backing sheet having one or more die-cut portions, a series of spaced score lines formed in the backing sheet adjacent each die-cut portion, the material of the backing sheet adjacent each die-cut portion being folded upwardly out of the plane of the backing sheet about a first score line, folded laterally about a second score line, and folded downwardly about a third score line to form at least one hollow projection extending out of the plane thereof; ii) a vacuum-formed clear plastic blister pack cover having at least one compartment formed therein for containing product(s) to be packaged, and one or more projections formed therein complemental in shape, number and location to the folded hollow projection(s) formed in the backing sheet; iii) the backing sheet and cover being disposed in face-to-face relation with the product(s) to be packaged disposed therebetween within the compartment.

21 Claims, 7 Drawing Sheets

PACKAGING SYSTEM

BACKGROUND OF THE INVENTION

1. Field of the Invention

The present invention relates generally to packaging; and, more particularly, to improved packaging arrangements for, and methods of packaging, a wide range of consumer products utilizing "blister packaging" techniques wherein the packaged products are clearly visible to the consumer, yet wherein: i) the quantity of non-biodegradable plastic materials used in the packaging system is minimized; ii) the resulting packages are characterized by their stability and integrity; iii) the resulting packages permit of application of considerably more advertising, promotional materials and other informative materials of value to both the retailer and the consumer than is presently possible with conventional packages of essentially the same dimensions; iv) the resulting packages are capable of on-edge stand-alone display or display on racks, pegboards and the like; and v), the resulting packages generally cost less than one-half (½) the cost of conventional comparably sized "clam shell" packages.

2. Prior Art

Prior to the advent of the present invention, a wide variety of packaging arrangements have been employed for virtually an infinite number of diverse consumer products. Typically, "blister packaging" technology commonly employs: i) a sheet of cardboard or similar relatively stiff backing material capable of having imprinted thereon advertising, other promotional materials and product information of value to the retailer and/or the consumer; and ii), a preformed, clear plastic blister pack cover having one or more pockets or compartments formed therein for containing and visually displaying the packaged product(s) and which can be heat bonded to the stiff backing sheet in the plane thereof.

Unfortunately, however, such packaging arrangements, while widely used today in the field of packaging for consumer products, have suffered from a number of disadvantages. For example, blister packages generally tend to be unstable and weak due to the fact that the card or other backing sheet lies in a single plane; and, the relatively thin plastic blister pack cover, which provides little structural rigidity, is sealed to the backing sheet in that single plane. Additionally, the backing sheet is exposed on at least one side, and often on portions of the opposite side, thereby increasing the danger of degradation to both the graphic and structural characteristics of the backing sheet. Moreover, any package of a given size—for example, a package eight inches (8") wide by twelve and one-half inches (12½") in height—has limited space available on the front and the back of the backing sheet for purposes of display of advertising material, promotional materials and/or product information. For example, in the exemplary case of a package eight inches (8") by twelve and one-half inches (12½"), only two hundred (200) square inches are available for such purposes.

Another type of conventional. packaging arrangement that has heretofore been, and is presently being, used is termed a "clam shell" package. Such packages commonly employ a preshaped, thin, clear plastic blister pack cover having two (2) complementally shaped portions coupled together by a "living hinge" and adapted to be folded about that hinge so as to enclose the product(s) to be packaged in one or more pockets or compartments between the two (2) facing plastic blister pack cover portions which are held together by ultrasonic bonding of the edges of the folded over cover portions together. Typically, a printed card is also inserted within the package to display graphic information; but, such card serves no structural purpose. Such an arrangement provides only a highly limited surface area suitable for application of promotional materials, advertising and product information on the printed card; and, of even more importance, it serves to effectively double the amount of non-biodegradable material used in each package producing undesirable environmental problems when attempting to dispose of used package materials. Moreover, clam shell packages tend to be unstable, bulky, labor-intensive and are generally more than double the cost of conventional blister packages.

SUMMARY OF THE INVENTION

The present invention overcomes the foregoing disadvantages inherent with conventional blister packages and clam shell packages for packaging consumer products by providing a packaging arrangement wherein the sheet of backing material (preferably a sheet having suitable graphics preprinted or otherwise applied thereto on at least the uppermost surface thereof) is precut to a desired pattern-which may or may not be of rectangular pattern form-and provided with a series of scored fold lines along, for example, at least one (1) longitudinal edge of the backing sheet; and, in some instances, along two (2), three (3), four (4), or even more, of the longitudinal edges of a polygonal backing sheet, enabling one (1) or more of the edges of the backing sheet to be folded upwardly at any desired included angle to the plane of the backing sheet, outwardly at any desired included angle to the upwardly folded portion, and downwardly at any desired included angle to the outwardly folded portion, thus defining a package backing sheet having a central planar area bounded by at least one (1) longitudinal folded edge (or, two, three, four or more folded edges in some instances) wherein each folded edge defines a generally inverted, U-shaped, hollow, channel-shaped projection or rail of any desired width and depth—for example, one and one-half inches (1½") deep, one-half inch (½") wide at the crest and from one-half inch (½") to approximately one inch (1") wide at the base of each channel-shaped rail.

To complete the package, the clear preformed plastic blister pack cover is preferably shaped—for example, by vacuum-forming in a conventional manner—to form a blister pack cover having at least one (1) generally inverted, U-shaped, hollow, clear plastic channel-shaped rail corresponding in location, number and configuration to the inverted hollow channel-shaped rail(s) formed on the folded, preprinted cardboard backing sheet, with the central region of the blister pack cover being formed with one or more pockets or compartments to receive and contain the product(s) to be packaged.

The foregoing arrangement permits display of advertising and promotional materials, as well as product information, on not only the front and the back of the central planar portion of the backing sheet, but, also, on the inside, outside and top surfaces of each generally inverted, U-shaped, hollow channel-shaped rail(s) formed on the backing sheet, thereby substantially increasing the surface area available for display of such information. For example, again assuming a typical exemplary package of approximately eight inches (8") by twelve and one-half inches (12½") in size, because the inside and outside walls of the hollow channel-shaped rails extend upwardly out of the plane of the planar central portion of the backing sheet, such surfaces are suitable for the application of printed advertising, promotional materials and/or other product information. Where the inverted, hollow, channel-shaped rails are one and one-half inches (1½") in height and surround the periphery of a package which is eight inches (8") by twelve and one-half inches (12½"), the available space for the application of printed advertising material, promotional materials and other product information can be increased from two hundred (200) square inches on the front and back of the backing sheet to up to on the order of three hundred and forty-one (341) square inches; or, an effective increase of 70.5% of the available surface area for displaying such information as compared with a conventional package having a flat planar eight inch (8") by twelve and one-half inch (12½") backing sheet.

Moreover, because both the backing sheet and the plastic blister pack cover are bounded by folded, generally inverted, U-shaped, hollow, channel-shaped rails, the stability, rigidity and strength of both package components are significantly enhanced. Such enhancement is even more significant when the two (2) components are nested together with the hollow, channel-shaped rails of the backing sheet being nested within the hollow channel-shaped rails of the blister pack cover; and, moreover, the structural rigidity and stability of the resulting package is further enhanced by virtue of the fact that the nested articles permit heated spot bonding of the two (2) package components together at discrete selected points—for example at complementally spaced points on the outside surfaces—both vertical and horizontal—of the hollow channel-shaped rails at the periphery of the backing sheet and at complementally located points on the inside surfaces of the hollow channel-shaped rails on the nested blister pack cover, as well as at complementally positioned spaced points where the two (2) packaging components are in face-to-face contact in the horizontal plane of the backing sheet and at the crests of the rails.

Indeed, a packaging arrangement in accordance with the present invention permits formation of rectangular box-shaped packages, or packages of non-rectangular shaped, of virtually any desired size and shape; and, wherein the breadth of the hollow channel-shaped side rails permit on-edge, stand-alone display of the packages, while at the same time the packages may still be displayed on racks, pegboards or the like. Additionally, since the two (2) package components are nested together in interfitting relationship, the ability to spot bond the components together at widely spaced points not only enhances the package's structural rigidity as compared to conventional packages but, moreover, it simplifies opening of the packages for the consumer who has ready access to areas of the two (2) nested package components which are located between adjacent spaced spot bonds and, therefore, which are not bonded together and may be easily separated.

Packaging arrangements embodying features of the present invention enjoy all of the advantages of conventional blister pack arrangements, including "clam shell" arrangements, without incorporating any of the disadvantages. Packages embodying features of the invention tend to simulate typical clam shell packages in terms of visual display of the packaged products and protection of the graphics; yet, are strong, more stable, easier to display on edge or otherwise, employ only one-half (½) of the non-biodegradable plastic materials, and cost less than one-half (½) the cost of a typical clam shell package. In short, packages embodying features of the invention: i) are capable of simulating a clam shell effect while using only half (½) of the non-biodegradable plastic material; ii) insure that greater surface area is available for printed advertising, promotional materials and informative information in a package of a given size; iii) are characterized by their stability, rigidity and greater strength; iv) can, through the application of heat and pressure, be effectively spot bonded together at spaced discrete points as contrasted with conventional packages which generally require bonding over virtually the entire peripheral areas of the two (2) components and, therefore, the resulting packages are easier to open; v) have greater on-edge stand-alone capability for purposes of display; and vi), provide protection of the entire preprinted backing sheet to insure graphic and structural integrity.

Of course, while the present invention has herein been described in conjunction with blister package components—e.g., a polygonal backing sheet and a complementally shaped clear plastic blister pack—cover having at least one (1) hollow channel-shaped rail formed adjacent at least one (1) longitudinal edge of each component and projecting upwardly out of the plane of the backing sheet; and, while the invention has been illustrated in connection with exemplary embodiments having two (2) or three (3) of such hollow channel-shaped rails along adjacent and/or opposite longitudinal edges thereof, and finds particular advantageous application in such embodiments; as the ensuing description proceeds it will become evident to persons skilled in the art that in its broadest aspects, the invention relates to blister packaging techniques wherein the two (2) basic package components—i.e., i) the backing sheet; and ii), the complementally shaped vacuum-formed blister pack cover—can be nested together in face-to-face contact over discrete regions lying in multiple planes and can be spot bonded together at discrete spaced points in such multiple planes. In that sense, it will be evident that the folded portion(s) of the backing sheet and the complementally shaped vacuum-drawn portion(s) of the plastic blister pack cover need not form one (1) or more "hollow channel-shaped rails" and need not be located adjacent one (1) or more edges thereof, provided only that the folded over portion(s) of the backing sheet define one (1) or more projections on the sheet with at least some surface area(s) of the projection(s) lying in one (1) or more planes other than the plane of the backing sheet and wherein the plastic blister pack cover is provided with vacuum-formed projection(s) complemental in number, shape and location to the projection(s) on the backing sheet so that when the backing sheet and cover are placed in face-to-face contact over at least portions of their planar regions, at least portions of the surfaces of the complemental projections project out of the plane of the backing sheet so as to enable bonding of one package component to the other in multiple planes.

DESCRIPTION OF THE DRAWINGS

These and other objects and advantages of the present invention will become more readily apparent upon reading the following Detailed Description and upon reference to the attached drawings, in which.

Figure 1:
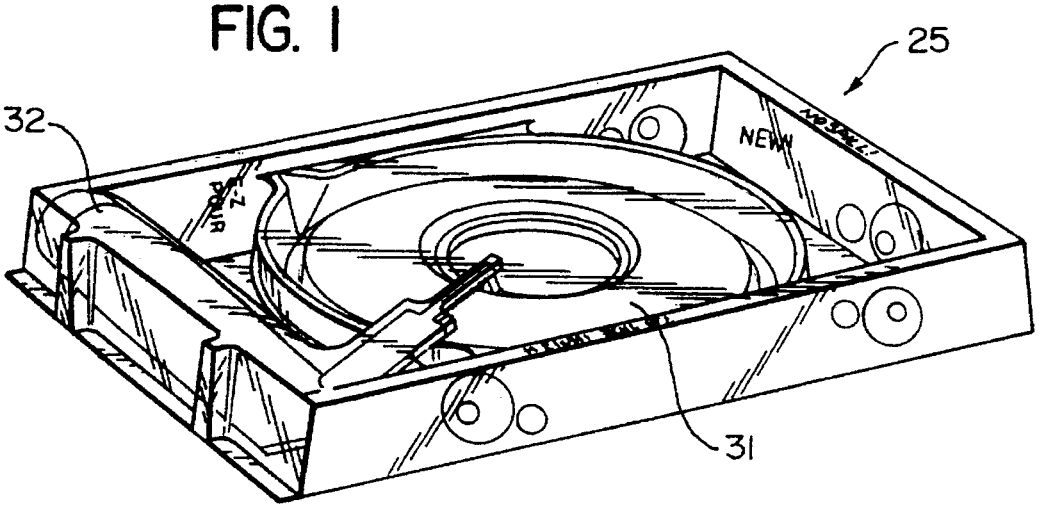
FIG. 1 is an isometric view of a blister pack embodying features of the present invention, here containing a bubble blowing toy and bubble blowing solution, and emphasizing the significantly enhanced surface area usable for advertising and promotional materials when packaging products in accordance with the invention.

While the invention is susceptible of various modifications and alternative forms, specific embodiments thereof have been shown by way of example in the drawings and will herein be described in detail. It should be understood, however, that it is not intended to limit the invention to the particular forms disclosed; but, on the contrary, the intention is to cover all modifications, equivalents and/or alternatives falling within the spirit and scope of the invention as expressed in the appended claims.

DETAILED DESCRIPTION

Figure 2:
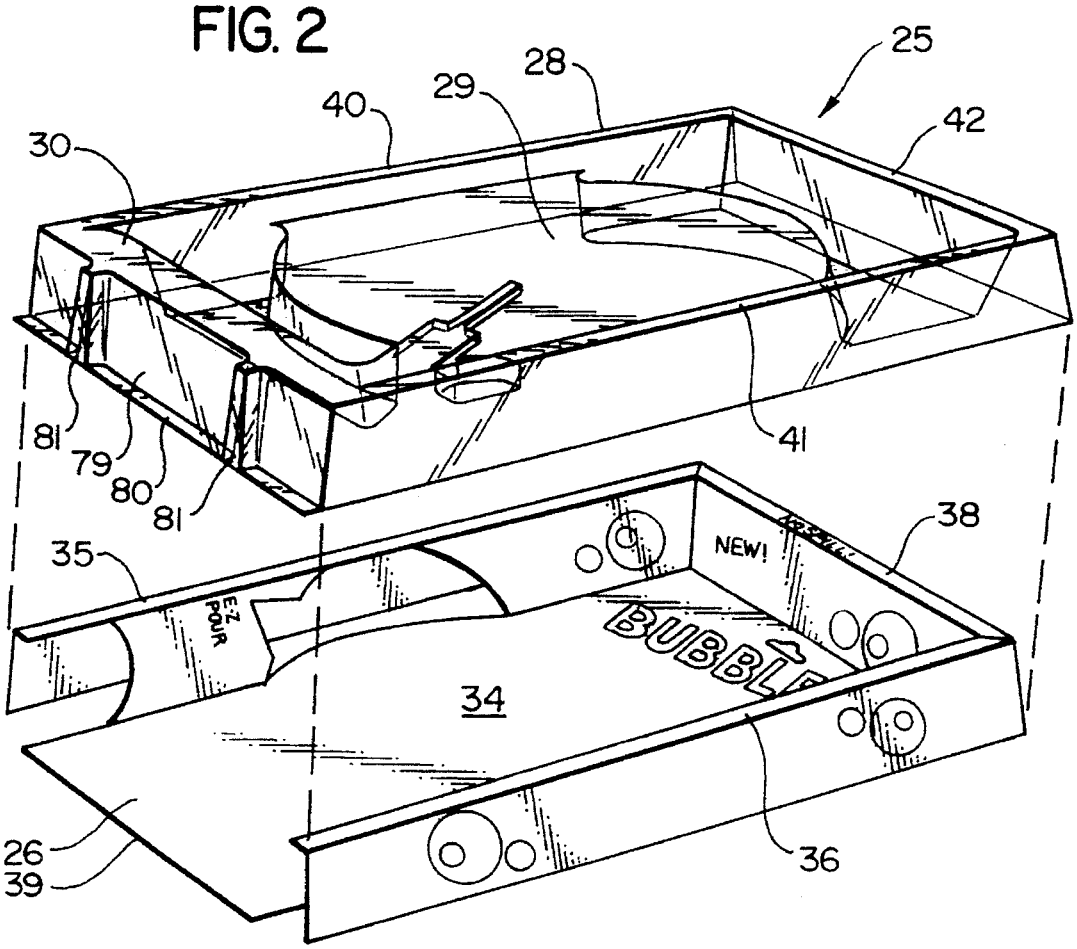
FIG. 2 is an exploded isometric view of the blister pack shown in FIG. 1 depicting the two components of an exemplary package made in accordance with the present invention, but wherein the products packaged therein have been eliminated for purposes of clarity.

Turning now to the drawings, and directing attention first to FIGS. 1 and 2 conjointly, an exemplary packaging system embodying features of the present invention has been generally indicated at 25. Thus, it will be observed that the exemplary package 25 includes a prefolded, preprinted, backing sheet 26 best shown in FIG. 2, and a preformed clear plastic blister pack cover 28 which here includes first and second inverted pockets 29, 30 for containing product(s) to be packaged. In the illustrative arrangement depicted in FIG. 1, the products positioned within the pockets 29, 30 respectively include a bubble-forming toy 31 adapted to be positioned within the pocket 29 and a tube 32 of bubble-forming solution adapted to be positioned within the pocket 30; but, as the ensuing description proceeds, those skilled in the art will appreciate that the present invention can be utilized effectively to package a wide range—indeed, a virtually unlimited range—of consumer products other than toys.

In accordance with one of the important aspects of the present invention, it will be observed that the preformed backing sheet 26 depicted in FIG. 2—a sheet which is preferably preprinted with suitable graphics and is typically formed of cardboard, paperboard or similar fibrous material—has been formed with a relatively large central planar region 34 upon which the product(s) to be packaged rest; left and right inverted, generally U-shaped, hollow, channel-shaped rails 35, 36 formed along the opposite longitudinal edges of the backing sheet 26 by folding thereof; and, an inverted, generally U-shaped, hollow, channel-shaped rail 38 formed along the top edge of the backing sheet 26. While not employed in the exemplary form of the invention depicted in FIGS. 1 and 2, those skilled in the art will appreciate that the bottom edge 39 of the backing sheet 26—which is here shown as planar and devoid of an inverted, U-shaped, hollow, channel-shaped rail—could also be prefolded so as to form such a rail, thus providing channel-shaped rails along all four (4) edges of the backing sheet 26.

Although not shown in considerable detail in FIGS. 1 and 2, those skilled in the art will appreciate that the backing sheet 26 will typically be preprinted with suitable graphic materials such, for example, as advertising and/or promotional materials relating to the packaged product(s), product specifications, warranty information, liability disclaimers, manufacturer and/or distributor information, product identification and/or price information .in legible and/or barcode format, etc. Moreover, the printed face(s) of the backing sheet 26 will typically be coated with a clear solvent-based coating which serves to: i) seal the backing sheet 26 and protect its structural integrity; ii) protect the integrity of the graphics printed thereon; and iii), apply a glossy finish thereto. Additionally, when heat is applied through the backing sheet 26 at selected discrete spaced points, the coating is softened or melted; and, upon cooling, serves to provide discrete, spaced, heated spot fusion bonds to the clear plastic blister pack cover 28 at such points. Such clear solvent-based coatings are completely conventional and can be obtained from Card Pak, Inc. in Cleveland, Ohio. In some instances, the clear coating may, for example, be formed of the same plastic as the clear plastic blister pack cover 28—e.g., polyvinylchloride ("PVC")—such that the application of heat at discrete points causes fusion of the blister pack cover 28 to the plastic coated backing sheet 26 at the discrete spaced points where heat is applied.

In keeping with the present invention, it will be observed that the preformed, clear plastic blister pack cover 28—which is preferably formed by conventional vacuum-forming techniques—is formed with left, right and top generally inverted, U-shaped, hollow, channel-shaped rails, 40, 41, 42, respectively, which are complemental in shape and location to respective ones of the rails 35, 36, 38 formed on the left, right and top edges of the backing sheet 26.

As previously indicated, the particular coating (not shown) applied to the front face of the backing sheet 26 and employed with the present invention is completely conventional and forms no part of the present invention except to the extent that the two (2) package components—viz., the backing sheet 26 and the clear plastic blister pack cover 28—are spot bonded together at discrete spaced points in multiple planes as contrasted with a conventional package where the backing sheet 26 and blister pack cover(s) 28 are generally bonded together in only a single horizontal plane.

Figure 3:
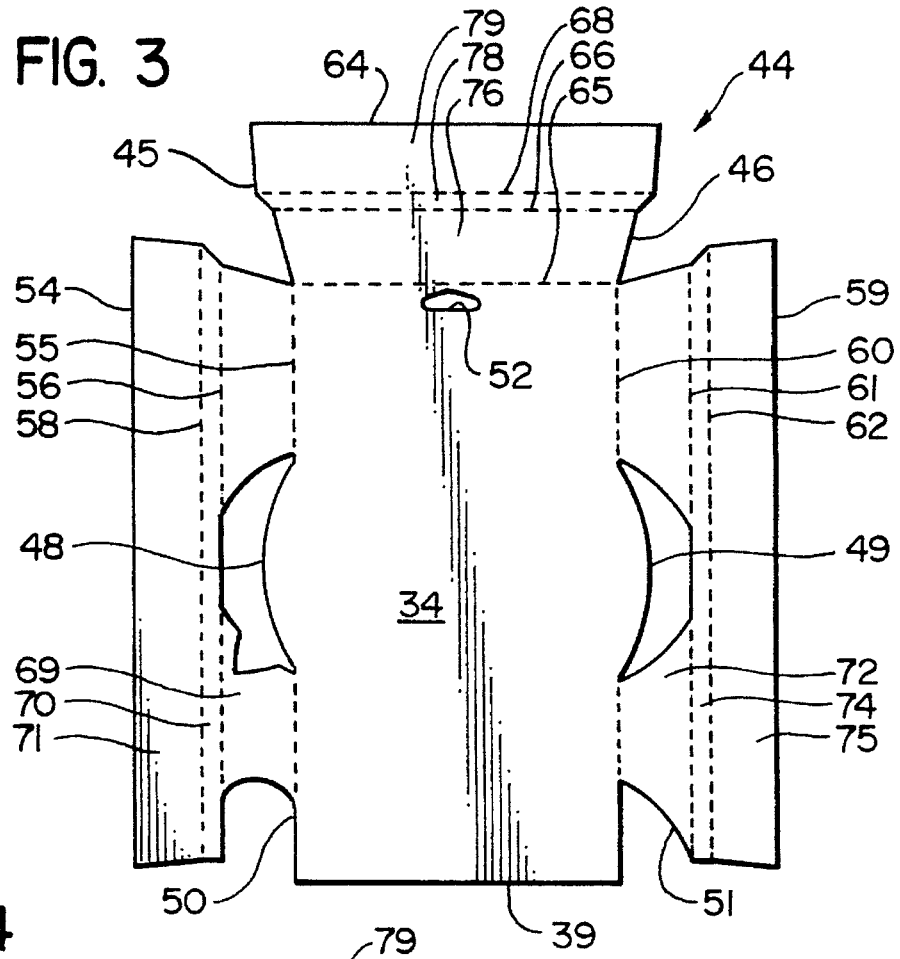
FIG. 3 is a pattern view, in plan, here depicting a typical generally rectangular backing sheet used with an exemplary package made in accordance with the invention and depicting the sheet in planar configuration with the scored fold lines being indicated by broken lines, but, wherein the preprinted advertising and related product. information has been deleted from the backing sheet for purposes of clarity.
Figure 10:
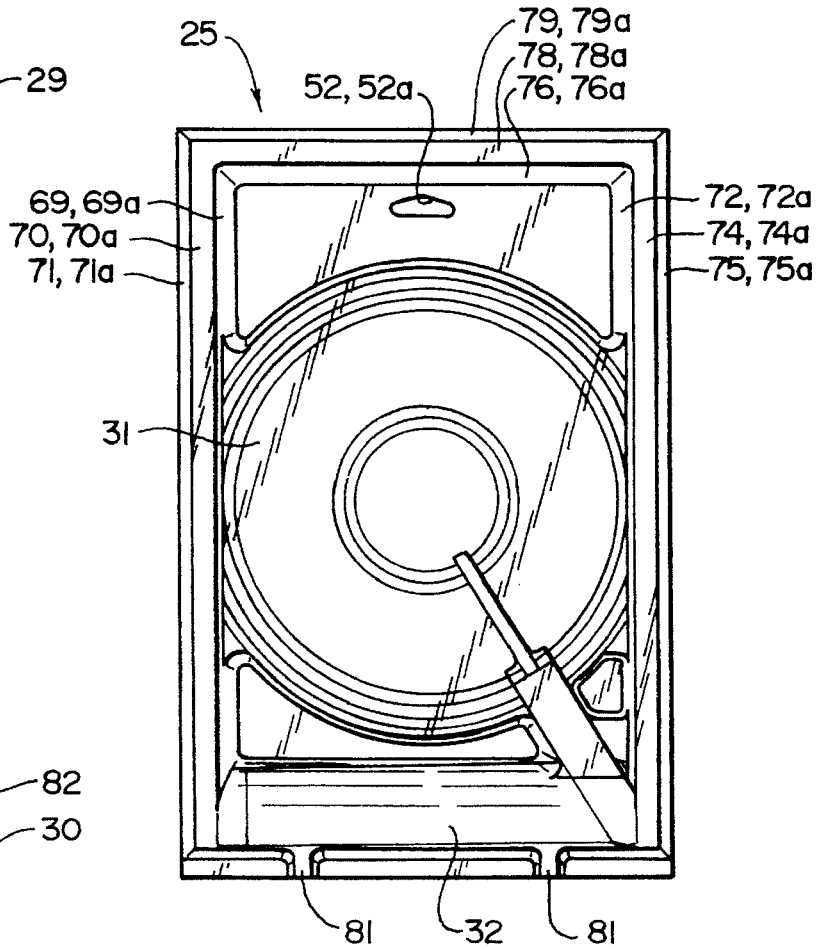
FIG. 10 is a plan view of the assembled exemplary package incorporating the fibrous backing sheet of FIGS. 3 through 6 and the clear plastic preformed blister pack cover of FIGS. 7 through 9 with the packaged products contained therein.

In carrying out the present invention, the backing sheet 26—which is preferably formed of cardboard, paperboard or similar fibrous material—is first cut in accordance with a suitable pattern dependent upon the nature of the product(s) to be packaged such, for example, as the exemplary pattern depicted generally at 44 in FIG. 3. Thus, a generally rectangular sheet of cardboard, paperboard or like material is provided with: i) left and right, generally V-shaped cutouts 45, 46 at its uppermost corners as viewed in FIG. 3; ii) left and right slightly arcuate cutouts 48, 49 formed just outboard of the central planar region 34 of the backing sheet with the cutouts 48, 49 being suitably shaped so as to receive and capture the opposite edges of the product to be packaged (here a bubble blowing toy 31 as shown in FIG. 1); iii) left and right arcuate cutouts 50, 51 adjacent the bottom edge 39 of the backing sheet 26 which are here suitable for capturing the opposite ends of the tube 32 of bubble blowing solution shown in FIGS. 1 and 10; and iv), a cutout 52 adjacent the upper central edge of the central planar portion 34 of the backing sheet 26, which cutout 52 is suitably shaped so as to permit hanging display of a completed package on a conventional pegboard or similar rack-type display.

In keeping with this aspect of the invention, the left edge 54 of the backing sheet 26 is provided with three (3) spaced parallel score lines 55, 56, 58; the right edge 59 is provided with three (3) spaced parallel score lines 60, 61, 62; and, the top edge 64 of the sheet 26 is provided with three (3) spaced parallel score lines 65, 66, 68. Thus, the arrangement is such that the cardboard or other material of the backing sheet 26 intermediate the score lines 55, 56 defines the inner, upwardly extending, generally vertical surface 69 of the left channel-shaped rail 35; the material intermediate the score lines 56, 58 defines the upper horizontal crest 70 of the left channel-shaped rail 35; and, the material intermediate the score line 58 and the left edge 54 of the sheet 26 defines the outer, upwardly extending, generally vertical surface 71 of the left channel-shaped rail 35. Similarly, the material intermediate the score lines 60, 61 defines the inner, upwardly extending, generally vertical surface 72 of the right channel-shaped rail 36; the material intermediate the score lines 61, 62 defines the upper horizontal crest 74 of the right channel-shaped rail 36; and, the material intermediate the right edge 59 of the backing sheet 26 and the score line 62 defines the outer, upwardly extending, generally vertical surface 75 of the right channel-shaped rail 36. Finally, the material intermediate the score lines 65, 66 defines the inner, upwardly extending, generally vertical surface 76 of the top channel-shaped rail 38; the material intermediate the score lines 66, 68 defines the upper horizontal crest 78 of the top channel-shaped rail 38; and, the material intermediate the top edge 64 of the backing sheet 36 and the score line 68 defines the outer, upwardly extending, generally vertical surface 79 of the top channel-shaped rail 38.

Figure 4:
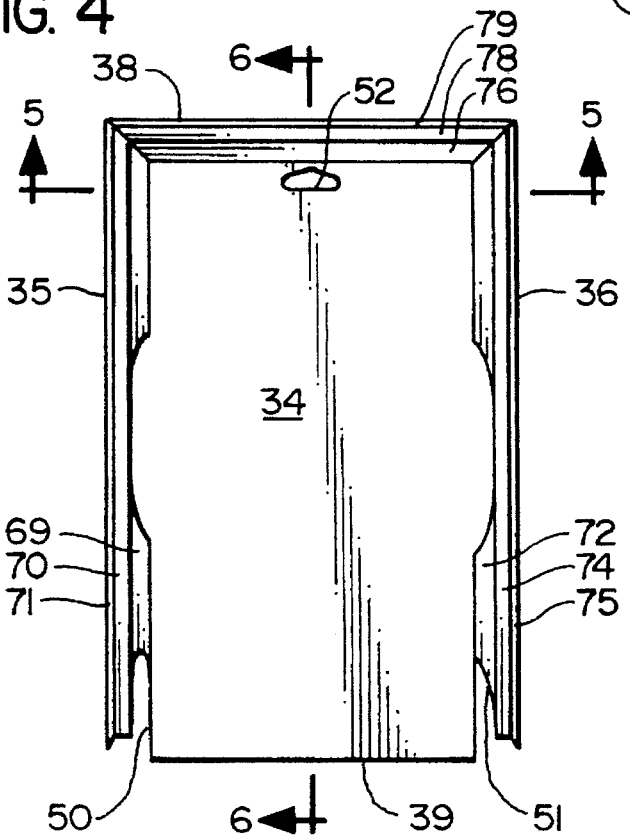
FIG. 4 is plan view of the backing sheet depicted in FIG. 3 after folding of the left side, right side and top of the sheet to form inverted, hollow, channel-shaped rails defining the top and two side edges of the sheet when folded for insertion into a premolded clear plastic blister pack cover.
Figure 5:
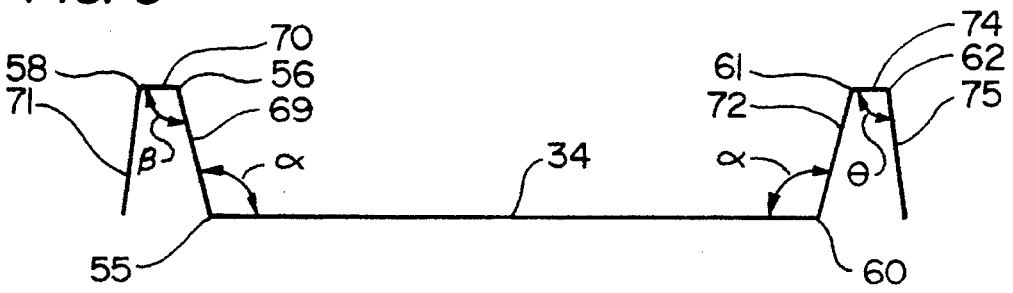
FIG. 5 is a pure cross-sectional view taken substantially along the line 5—5 in FIG. 4, with background structure eliminated for purposes of clarity, here depicting the cross-sectional configuration of the backing sheet and its two side channel-shaped rails following folding thereof.
Figure 6:
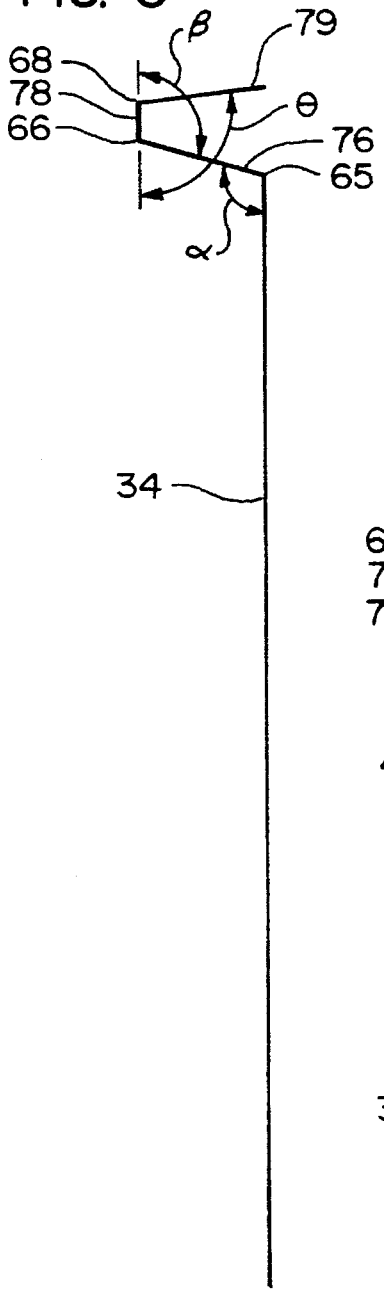
FIG. 6 is a pure cross-sectional view taken substantially along the line 6—6 in FIG. 4, with background structure eliminated for purposes of clarity, here depicting the cross-sectional configuration of the sheet and its top channel-shaped rail following folding thereof.

To prefold the backing sheet 26 depicted in pattern form in FIG. 3, and as best observed by reference to FIGS. 4, 5 and 6 conjointly, the left, right and top edges 54, 59, 64 of the backing sheet 26 are folded upwardly out of the plane of the backing sheet about respective ones of the innermost score lines 55, 60, through any desired included angle a which can, merely by way of example, range from between about 30° and about 160°; but, which is approximately 105° in the particular exemplary embodiment shown in FIGS. 5 and 6. The left, right and top edges 54, 59, 64 of the backing sheet 26 are then folded outwardly about respective ones of the intermediate score lines 56, 61, 66 into a generally horizontal plane through an included angle S which, in the exemplary embodiment shown in FIGS. 5 and 6, comprises an included angle of approximately 105°; and, finally, the left, right and top edges 54, 59, 64 of the backing sheet 26 are folded downwardly about respective ones of the outermost score lines 58, 62, 68 through an included angle Θ which, in the exemplary embodiment shown in FIGS. 5 and 6, comprises an included angle of approximately 100°.

The particular angular degree of folding through the angles α, β and Θ is not critical to the present invention and can be varied widely to suit the particular final package configuration desired. For example, the folds can all be substantially right angular 90° folds (not shown), in which event the resulting channel-shaped rails 35, 36, 38 would define a regular cross sectional. configuration in which the inner and outer sides of the rails would be parallel and spaced apart. However, excellent results have been achieved when the angles α, β and Θ through which the material of the backing sheet 26 is folded are selected such that the width of the resulting folded generally U-shaped or channel-shaped rails at. the crests 70, 74, 78 of the respective rails 35, 36, 38 is approximately one-half (½) the width at the bases of the rails.

Figure 7:
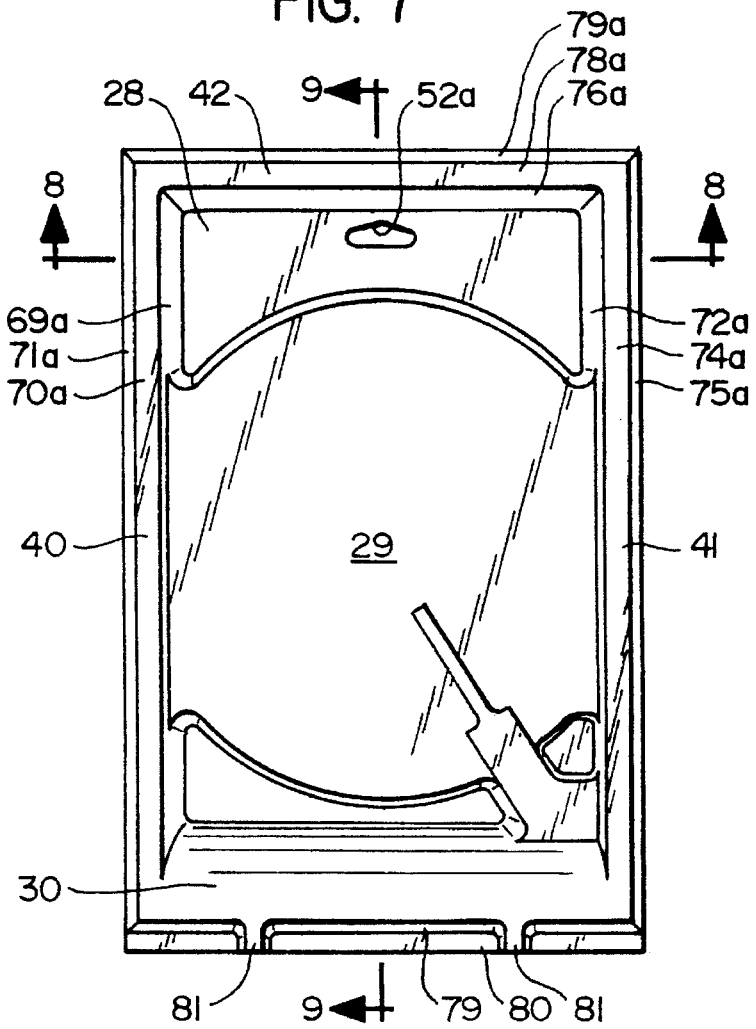
FIG. 7 is a plan view of the preformed clear plastic sheet defining the blister pack cover portion of the exemplary blister pack shown in FIG. 1.
Figure 8:
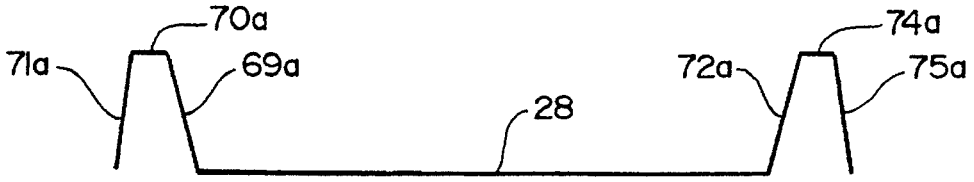
FIG. 8 is a pure cross-sectional view taken substantially along the line 8-8 in FIG. 7, with background structure eliminated for purposes of clarity, here illustrating the cross-sectional configuration of the clear plastic sheet and its complemental interfitting relationship with the folded, generally inverted, U-shaped, hollow, channel-shaped rails formed on the opposite longitudinal sides of the backing sheet depicted in FIG. 5.
Figure 9:
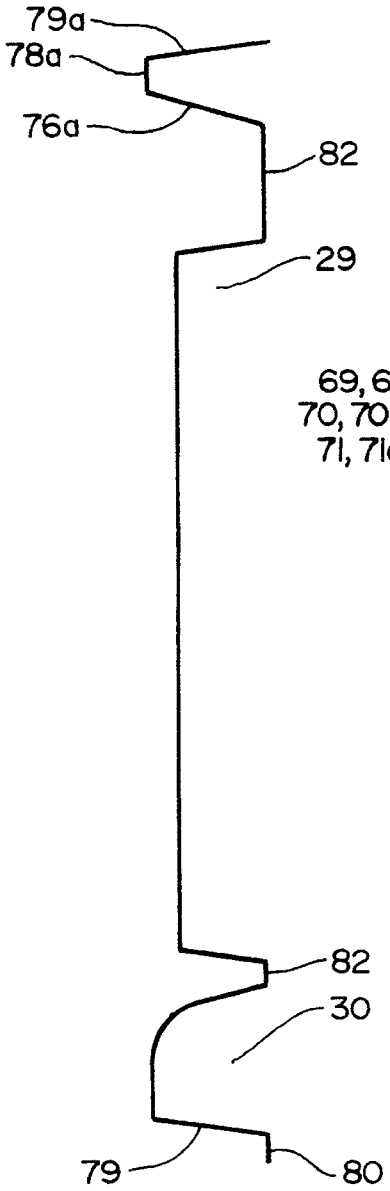
FIG. 9 is a pure cross-sectional view taken substantially along the line 9—9 in FIG. 7, with background structure eliminated for purposes of clarity, again depicting the cross-sectional configuration of the clear plastic sheet and its complemental interfitting relationship with the folded, generally inverted, U-shaped, hollow, channel-shaped rail formed on the top edge of the backing sheet depicted in FIG. 6 and illustrating also the vacuum-formed pockets formed in the blister pack cover for capturing and displaying the product(s) to be packaged.

Considering next FIGS. 7, 8 and 9 conjointly, it will be observed that the preformed clear plastic blister pack cover 28—which is preferably vacuum-formed using completely conventional vacuum-forming techniques for plastic sheet materials such, for example, as PVC—is formed with left, right and top inverted, generally U-shaped, hollow, channel-shaped rails 40, 41, 42 which are complemental in shape and location to the left, right and top channel-shaped rails 35, 36, 38 formed on the backing sheet 26, with the rails 40, 41, 42 on the blister pack cover 28 having innermost upwardly extending, generally vertical surfaces 69*a*, 72*a*, 76*a*, generally horizontal crests 70*a*, 74*a*, 78*a*, and outermost upwardly extending, generally vertical surfaces 71*a*, 75*a*, 79*a* which are adapted to lie in face-to-face contact with respective ones of the corresponding innermost upwardly extending, generally vertical surfaces 69, 72, 76, upper crests 70, 74, 78 and outermost upwardly extending, generally vertical surfaces 71, 75, 79 of the left, right and top channel-shaped rails 35, 36, 38 on the prefolded backing sheet 36 when the two package components 26, 28 are placed in assembled nested relationship.

Additionally, during the conventional vacuum-forming process (not shown), one or more suitable pockets—here, two (2) pockets 29, 30—are drawn in the plastic material defining the blister pack cover 28 to form compartments for capturing and retaining the particular product(s) to be packaged. As best shown upon inspection of FIGS. 7 and 9, it will be noted that the pocket 30 terminates in a downwardly flaring bottom wall 79 and an outwardly flaring horizontal flange 80 adapted to be placed in face-to-face contact with the bottom edge 39 of the backing sheet 26. A pair of suitably shaped feet 81 are formed at spaced points along the downwardly flaring bottom wall 79 of pocket 30 so as to facilitate on-edge stand-alone display of the completed package 25. Finally, the vacuum-formed blister pack cover 28 is provided with a cutout 52*a* which is complemental in shape and location to the cutout 52 (FIG. 3) formed in the backing sheet 26 so as to permit pegboard and other rack-type mounting.

In order to assemble the package 25 (FIGS. 1 and 10), the plastic blister pack cover 28 is preferably inverted and placed in a suitable complementally shaped female jig or fixture forming part of a press (not shown). The particular product(s) to be packaged—here the bubble blowing toy 31 and tube of bubble blowing solution 32 (FIGS. 1 and 10)—is (are) placed in respective ones of the upwardly facing open pockets 29, 30; and, the now folded backing sheet 26 is inverted and placed on the inverted plastic blister pack cover 28 with the backing sheet's channel-shaped rails 35, 36, 38 being received and nested within respective ones of the channel-shaped rails 40, 41, 42 on the inverted plastic blister pack cover 28.

In this condition, the surfaces 80, 82 (FIG. 9) of the blister pack cover 28 are in face-to-face contact with the central planar portion 34 of the backing sheet. 26 in a first horizontal plane; the upper surfaces 70, 74, 78 on the crests of the nested channel.shaped rails 35, 36, 38 on the backing sheet 26 are in face-to-face contact with respective different ones of the inner crest surfaces 70*a*, 74*a*, 78*a* on respective ones of the channel-shaped rails 40, 41, 42 of the blister pack cover 28 in a second horizontal plane spaced vertically above the first horizontal plane; and, the innermost/outermost upwardly extending, generally vertical surfaces 69, 72, 76/71, 75, 79 on respective ones of the backing sheet's channel-shaped rails 35, 36, 38 are in face-to-face contact with the correspondingly numbered innermost/outermost upwardly extending, generally vertical surfaces 69*a*, 72*a*, 76*a*/71*a*, 75*a*, 79*a* on respective ones of the channel-shaped rails 40, 41, 42 on the left, right and top edges of the blister pack cover 28, such areas of face-to-face contact lying in six (6) different generally vertical planes in the exemplary embodiment shown.

At this point in the assembly process, a male fixture (not shown) on the press which is complemental in shape to the inverted backing sheet 26 is lowered so as to apply pressure to the back side of the backing sheet 26 and to press the mating face-to-face surfaces of the prefolded, preprinted backing sheet 26 and the blister pack cover 28 into intimate contact; heat is applied at discrete spaced points located on the male fixture and is passed through the backing sheet 26 to melt the clear solvent-based or other plastic coating (not shown) on the preprinted front side of the backing sheet 26 so as to cause the coating to heat bond to the plastic blister pack cover 28 at the preselected spaced discrete points. Upon cooling and setting of the thus-formed discrete, spaced, fusion bonds, the male fixture is raised, and the completed package 25 (FIGS. 1 and 10) is removed from the press (not shown).

Figure 11:
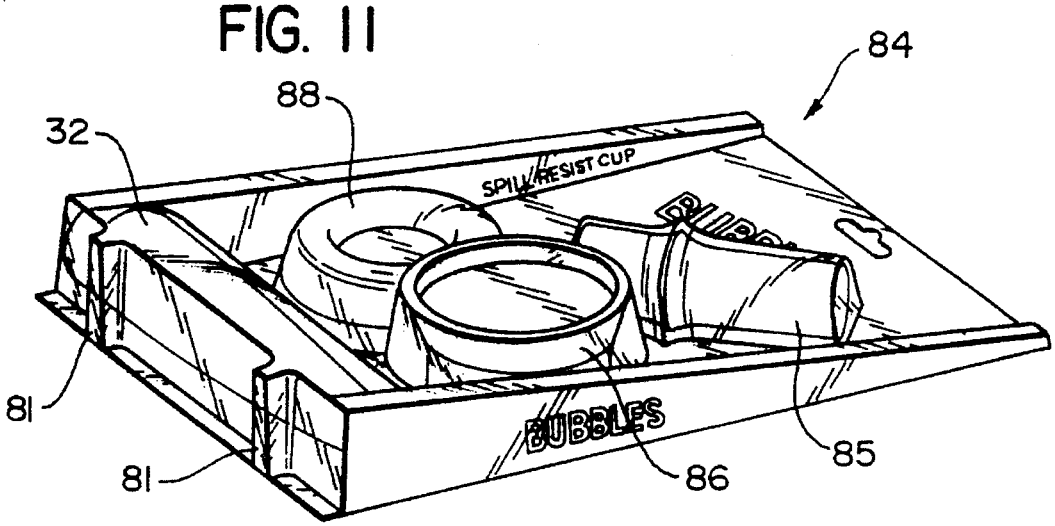
FIG. 11 iS an isometric view similar to FIG. 1, but here depicting a slightly modified configuration for an exemplary blister pack made in accordance with the present invention.
Figure 12:
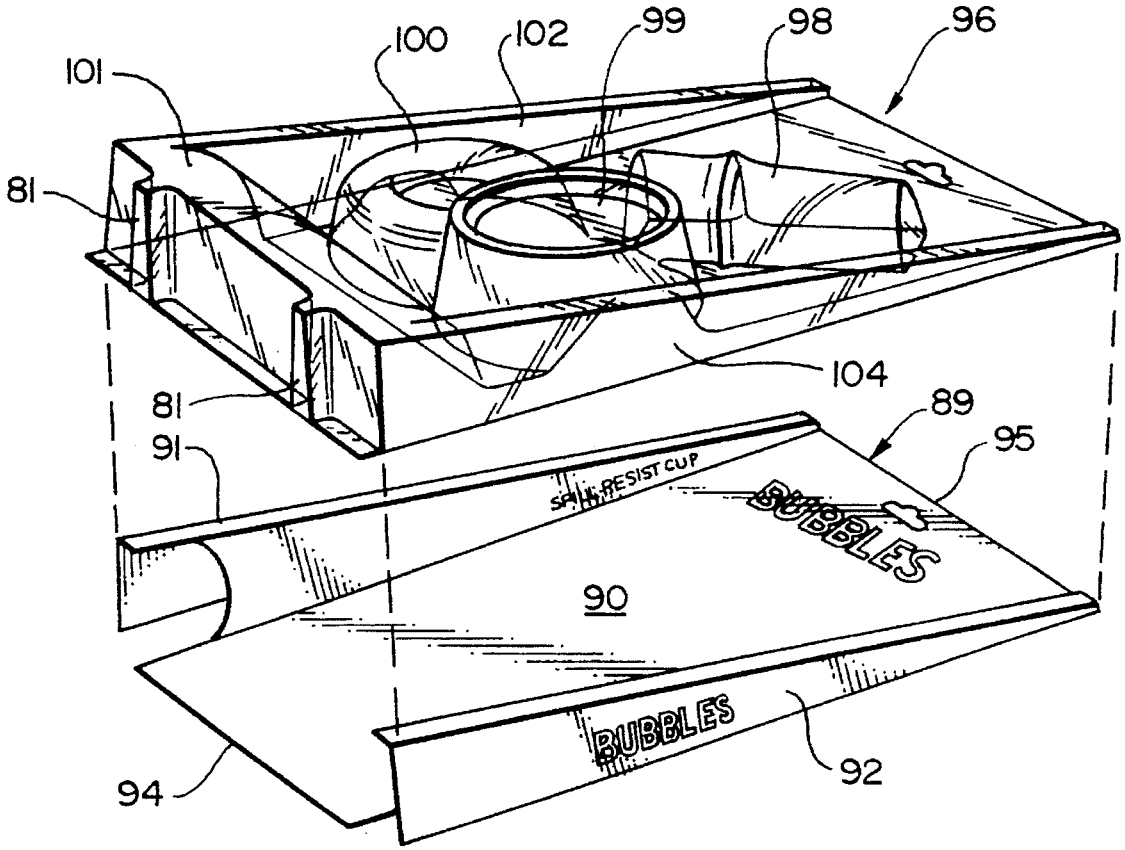
FIG. 12 is an exploded isometric view of the blister pack shown in FIG. 11 depicting the two components of the modified packaging arrangement embodying features of the present invention, but wherein the products packaged therein have been eliminated for purposes of clarity.

Considering next FIGS. 11 and 12 conjointly, a slightly modified form of blister package, generally indicated at 84, has been illustrated and which again embodies features of the present invention. As in the case of the embodiment of the invention depicted in FIGS. 1 through 10, the exemplary package 84 depicted in FIG. 11 is here shown as used for packaging a bubble blowing toy which here comprises a bubble blowing brush 85, a two-part spill-proof container for bubble blowing solution and consisting of a cup 86 and a removable cover 88, and a tube 32 of bubble blowing solution.

Referring to FIG. 12, the exemplary package 84 depicted in FIG. 11 has been shown in exploded isometerc form with the bubble blowing toy components and solution removed for purposes of clarity. Thus, it will be noted that the exemplary package includes a fibrous backing sheet 89 (preferably made of cardboard, paperboard or the like) having a generally planar central portion 90, left and right generally inverted, U-shaped, hollow, channel-shaped rails 91, 92, and bottom and top edges 94, 95 respectively, which are devoid of channel-shaped rails. In this embodiment, however, the channel-shaped rails 91, 92 are somewhat triangular when viewed in side elevation, tapering from a maximum height adjacent the bottom edge 94 to a minimum height adjacent the top edge 95.

In carrying out this aspect of the present invention, the exemplary package 84 includes a vacuum-formed clear plastic blister pack cover, generally indicated at 96, having pockets 98 (for reception of the bubble blowing brush 85 shown in FIG. 11), 99 (for reception of the cup 86), 100 (for reception of the cover 88), and 101 (for reception of the tube 32 of bubble blowing solution). The illustrative vacuum-formed blister pack cover 96 is further provided with left and right inverted, generally U-shaped hollow, channel-shaped rails 102, 104 which are complemental in shape and location to respective ones of the rails 91, 92 formed on the backing sheet 89; and, additionally, with spaced feet 81 along the bottom edge of the cover 96 which are identical in structure and function to the feet 81 previously described in connection with the embodiment of the invention shown in FIGS. 7 and 9.

Figure 13:
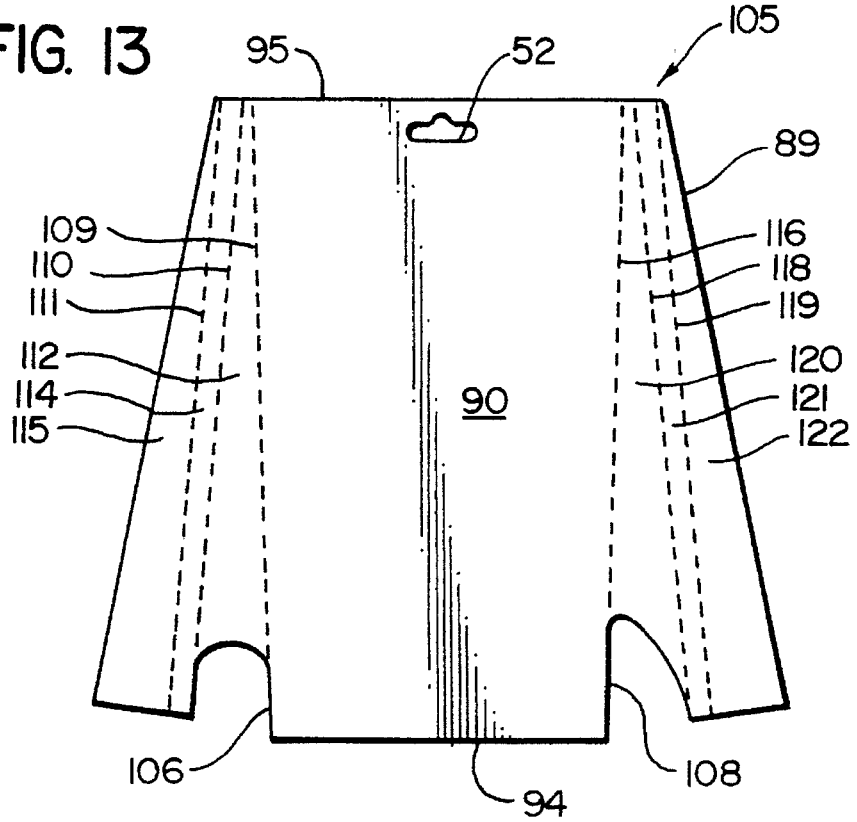
FIG. 13 is a pattern view, in plan, similar to that of FIG. 3, but here depicting a non-rectangular pattern for the exemplary cardboard backing sheet used with the package shown in FIG. 11.

In order to form a backing sheet having triangular channel-shaped rails 91, 92 when viewed in side elevation such, for example, as the backing sheet 96 depicted in FIG. 12, a non-rectangular backing sheet pattern, generally indicated at 105 in FIG. 13, is employed. In this instance, the backing sheet pattern 105 is provided with left and right spaced cutouts 106, 108 adjacent the opposite sides of the lower edge 94 of the central planar region 90 for purposes of capturing and retaining the opposite ends of the tube 32 (FIG. 11) of bubble blowing solution when the package 84 is assembled; and, additionally, the upper portion of the central planar region 90 of the backing sheet 89 is provided with a cutout 52 adjacent the top edge 95 for purposes of permitting display of the completed package 84 on pegboards and/or with similar rack-type displays.

In carrying out this aspect of the invention, the backing sheet pattern 105 is provided with a series three (3) spaced score lines 109, 110, 111 adjacent its left edge with the score lines 109, 110 converging towards the top edge 95 of the backing sheet, the score lines 110, 111 being parallel, and the score line 112 and left edge of the backing sheet 89 converging toward the top edge 95 of the sheet. Thus, the arrangement is such that the material 112 between the score lines 109, 110 is generally triangular in shape, the material 114 between the score lines 110, 111 is of constant width, and the material 115 between the outermost score line 111 and the left edge of the backing sheet 89 is also generally triangular in shape.

In like manner, the right edge of the backing sheet 89 is provided with a similar series of three (3) score lines 116, 118, 119 wherein score lines 116, 118 converge towards the top edge 95 of the sheet 89, score lines 118, 119 are parallel, and score line 119 and the right edge of the backing sheet 89 converge toward the top edge 95 of the backing sheet. Thus the arrangement on the right edge of the backing sheet 89 is identical to that on the left edge, with the material 120 between score lines 116, 118 being generally triangular in shape, the material between score lines 118, 119 being of uniform width, and the material 122 between score line 119 and the right edge of the backing sheet 89 being generally triangular in shape.

Figure 15:
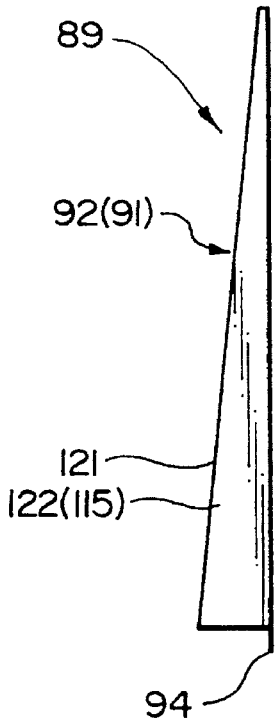
FIG. 15 is a side elevational view of the preformed cardboard backing sheet depicted in FIG. 13 following folding thereof.
Figure 17:
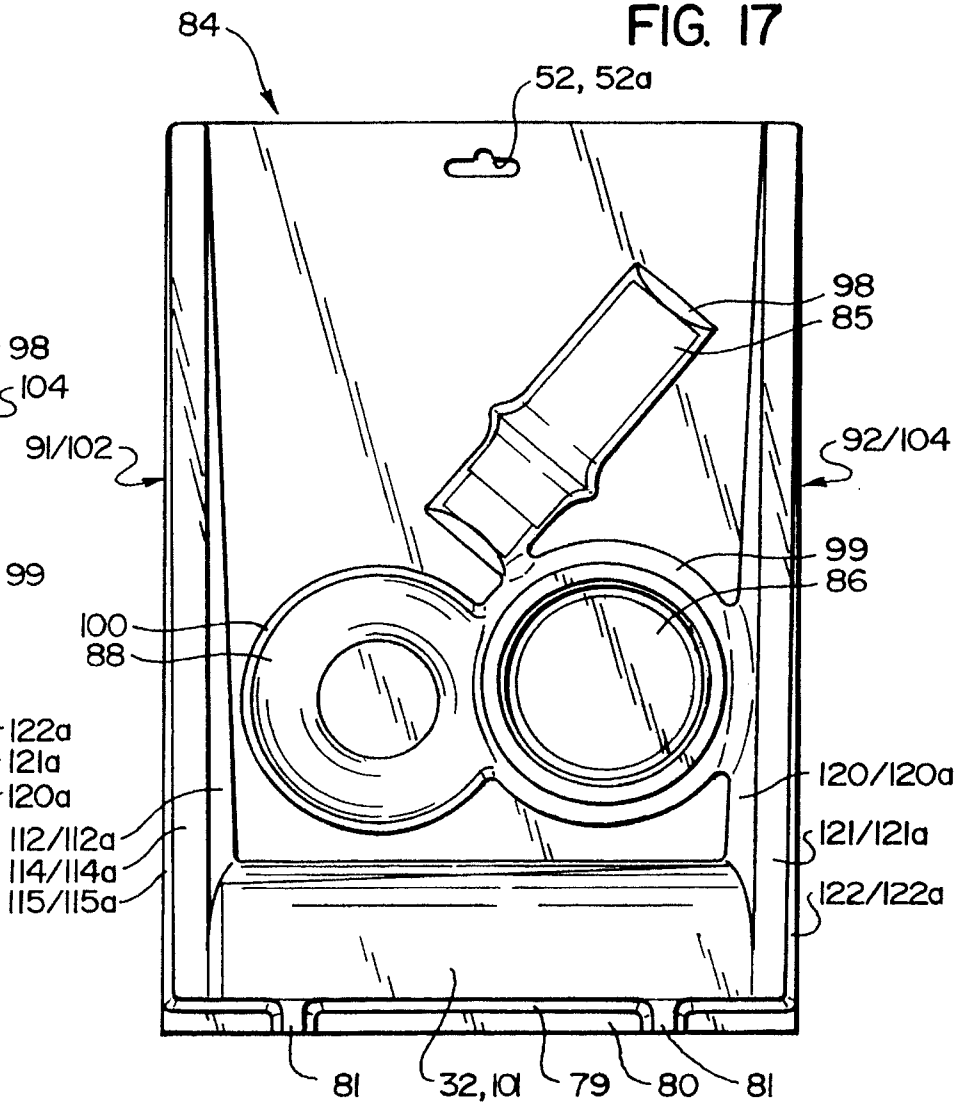

In this instance, the left and right edges of the backing sheet 89 are folded: i) upwardly out of the plane of the backing sheet about respective ones of the score lines 109, 116 through any desired included angle with the plane of the backing sheet (here an angle of approximately 105°); ii) outwardly about respective ones of the score lines 110, 118 through any desired included angle with respect to the upwardly folded portions (again, an angle of approximately 105° in the exemplary case); and iii), downwardly about respective ones of score lines 111, 119 through any desired included angle with respect to the outwardly folded portions (here an angle of approximately 100°). Thus, the folded condition of the backing sheet 89 produces left and right, hollow, channel-shaped rails 91, 92 which are characterized in that they are of constant width along the crests of the rails 91, 92 as defined by the material regions 114, 121 respectively, yet they are of progressively decreasing depth from the bottom edge 94 of the backing sheet 89 toward the top edge 95 thereof, defining generally triangular channel-shaped rails when viewed in side elevation, as best shown in FIG. 15.

Of course, those skilled in the art will appreciate that the final desired configuration of the channel rails 91, 92 can be easily modified still further—for example, by arranging the score lines 110, 111 (as well as the score lines 118, 119) in a non-parallel array where they converge towards one of the bottom and top edges 94, 95 of the sheet 89 while diverging toward the other edge so as to produce left and right channel-shaped rails 91, 92 having diverging/converging widths as viewed in plan.

Figure 16:
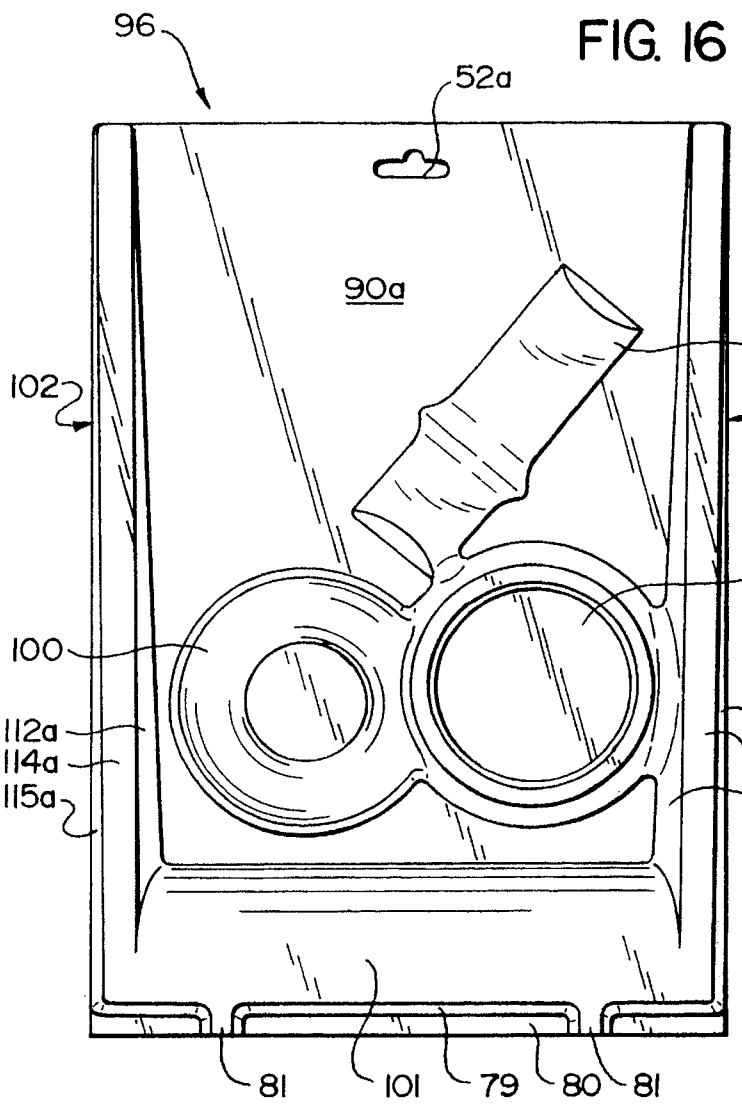
FIG. 16 is a plan view of the preformed clear plastic blister pack cover used with the package depicted in FIG. 11; and, FIG. 17 is a plan view of the assembled blister pack with products contained therein and employing a backing sheet of the type shown in FIGS. 13 through 15 and a clear plastic blister pack cover of the type shown in FIG. 16.

Referring next to FIGS. 12 and 16, it will be noted that the blister pack cover 96 used with the blister package 84 (FIG. 11) is vacuum-formed so as to have left and right hollow channel-shaped rails 102, 104 which are complemental in shape and location to respective ones of the channel-shaped rails 91, 92 on the backing sheet 89 such that when they are placed in a nested arrangement, the inside surfaces **112*a*, 114*a*, 115*a* of the left channel-shaped rail 102 on the blister pack cover 96 are in face-to-face contact with the corresponding ones of the outer surfaces 112, 114, 115 of the left channel-shaped rail 91 on the backing sheet 89. Similarly, the inside surfaces 120*a*, 121*a*, 122*a* on the right channel-shaped rail 104 of the blister pack cover 96 are in face-to-face contact with the corresponding outer surfaces 120, 121, 122 on the right channel-shaped rail 92 on the backing sheet 89. Finally, the planar central region 90a of the blister pack cover 96 is in face-to-face contact with the planar central region 90 of the backing sheet 89 in all areas except where the pockets 98, 99, 100 and 101 are formed. Additionally, the upper edge of the planar central region 90*a* of the blister pack cover 96 is provided with a cutout 52*a* comparable in shape and location to the corresponding cutout 52 on the backing sheet 89** so as to permit mounting of the completed package on pegboards and similar rack-type displays.

In further keeping with the invention, when the clear plastic blister pack cover 96 shown in FIG. 16 is vacuum-formed, the fixture (not shown) is shaped such that pockets 98, 99, 100, 101 of varying, but selectable, depth and shape are formed in the central planar region 90a of the cover 96, with such pockets or compartments being sized and shaped to receive and accommodate the products to be packaged—here, a bubble blowing brush 85, a two-piece spill-proof container having a cup 86 and a cover 88, and a tube 32 of bubble blowing solution, all as shown in FIG. 11.

Figure 14:
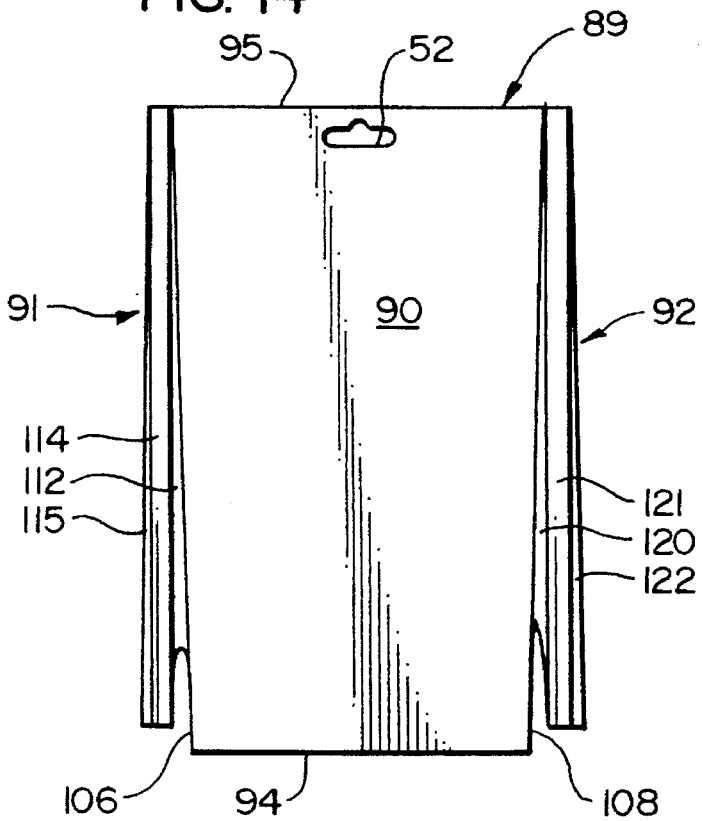
FIG. 14 is a plan view similar to FIG. 4, but here depicting the cardboard backing sheet of FIG. 13 folded into its three-dimensional configuration prior to assembly with a preformed clear plastic blister pack cover.

As.in the case of the embodiment of the invention depicted in FIGS. 1 through 10 and described above, in order to assemble the blister package 84 of FIG. 11, it is merely necessary to: i) invert the plastic blister pack cover 96 shown in FIG. 16; ii) place the inverted cover 96 in a suitable complementally shaped female jig or fixture of a press (not shown); iii) place the products 85, 86, 88, 32 to be packaged into respective ones of the compartments 98, 99, 100, 101 of the inverted cover 96; iv) invert the backing sheet 89 (FIG. 14); v) place the inverted backing sheet 89 in nested relation with the inverted cover 96 with the backing sheet's channel-shaped rails 91, 92 being positioned within respective ones of the channel-shaped rails 102, 104 on the cover and with the upper, exposed, preprinted and coated surface of the backing sheet 89 being in juxtaposition to the products 85, 86, 88, 32 to be packaged and in face-to-face contact with the plastic cover 96 in the mating areas **90/90*a*, 112/112*a*, 114/114*a*, 115/115*a*, 120/120*a*, 121/121*a* and 122/122*a*; vi) shift the male fixture of the press (not shown) downwardly into intimate engagement with the back side of the backing sheet 89; and vii), apply pressure and heat at discrete spaced selected spots over the regions of face-to-face contact between the backing sheet 89 and the cover 96 so as to create discrete spaced spot fusion bonds therein in the horizontal plane of the backing sheet, the plane of the crests 114/114*a*, 121/121*a* of the nested channel-shaped rails 91/102, 92/104, and in the planes of face-to-face contact between the upwardly extending inner and outer sides 112, 115, 120, 122 of the backing sheet 96 and the inner and outer sides 112*a*, 115*a*, 120*a*, 122*a*** of the cover.

It will be evident that blister packages such as that depicted at 84 in the embodiment of the invention shown in FIGS. 11 through 17 are particularly advantageous because the nested tapering channel-shaped rails 91/102, 92/104 provide the added benefit of permitting bonding of the package components 89, 96 together at discrete spaced points lying in virtually an infinite number of planes, thereby further enhancing the structural integrity of the package 84.

Those skilled in the art will appreciate from the foregoing description taken in conjunction with the accompanying drawings that there have herein been disclosed blister packages, methods of making the same, and patterns suitable for use therewith, which are characterized in that the resulting blister packages made in accordance with the invention include virtually all of the advantageous features of conventional blister packages and conventional clam shell packages, yet wherein: i) the quantity of non-biodegradable plastic materials used in the packaging system is minimized; ii) the resulting packages are characterized by their stability and integrity; iii) the resulting packages permit of application of considerably more advertising, promotional materials and other informative materials of value to both the retailer and the consumer than is presently possible with conventional packages of essentially the same dimensions; iv) the resulting packages are capable of on-edge stand-alone display or display on racks, pegboards and the like; and v), the resulting packages generally cost less than one-half (½) the cost of conventional comparably sized "clam shell" packages.

Moreover, those skilled in the art will also appreciate that the rails along opposite edges of the packages—for example, the rails 35, 36 of the backing sheet 26 shown in FIGS. 3 and 4—need not be parallel, nor do the depth or width of the rails have to be constant along the entire length thereof. Thus, packages made in accordance with the invention can be triangular, rectangular, or of any other desired polygonal shape; and, they can include non-rectilinear edges outboard of the channel-shaped rails or on edges where no channel-shaped rails are formed. The rails may be of constant width and/or depth, or they can progressively increase or decrease in either or both of depth and/or width from one rail end to the opposite rail end.

Indeed, as previously indicated, it will be apparent to persons skilled in the art that, in its broadest aspects, the invention is not limited to blister packages having one or more channel-shaped rails which is (are) substantially coextensive with a package edge, but, rather, the invention embraces blister packages having: i) a planar backing sheet of virtually any shape wherein at least a portion of the sheet, whether along one (1) or more edges or interiorly of the sheet, is suitably die-cut and folded out of the plane of the sheet to form one (1) or more projection(s) on the sheet with the backing sheet and surface(s) on the projection(s) formed thereon lying in multiple planes; ii) a clear plastic vacuum-formed blister pack cover shaped complementally with respect to the backing sheet and having surface areas positioned to be placed in face-to-face contact with the backing sheet in multiple planes; and iii), discrete spaced spot bondS, whether fusion, heated or other type of bondS, between the two (2) packaged components and located at discrete spaced points in multiple planes.

We claim:

1. The method of forming a blister package containing product(s) to be packaged for delivery to consumers, the method comprising the steps of:

a) forming a thin planar backing sheet of fibrous material having at least one (1) die-cut edge;

b) folding the backing sheet along the at least one (1) die-cut edge out of the plane of the sheet about at least one (1) score line located adjacent the at least one (1) die-cut edge of the sheet so as to form at least one projection extending upwardly out of the plane of the backing sheet;

c) forming a vacuum-formed blister pack cover from a sheet of clear plastic material with the cover having a planar region, at least one (1) downwardly facing vacuum-formed pocket or compartment suitable for reception and containment of the product(s) to be packaged, and at least one (1) vacuum-formed projection complemental in shape, number and location to the at least one (1) folded projection on the backing sheet;

d) inverting the blister pack cover and placing the inverted cover in a complementally shaped female fixture of a press with the pocket(s) or compartment(s) formed therein facing upwardly;

e) positioning the product(s) to be packaged in the upwardly facing pocket(s) or compartment(s) in the inverted blister pack cover;

f) inverting the folded backing sheet formed in steps (a) and (b) and placing the inverted backing sheet on the inverted blister pack cover with the at least one (1) folded projection formed on the backing sheet disposed in face-to-face contact with a corresponding one of the at least one (1) complementally shaped vacuum-formed projection on the vacuum-formed blister pack cover and with the planar region of the blister pack cover surrounding the pocket(s) or compartment(s) formed therein being in face-to-face contact with the planar region of the backing sheet;

g) shifting a male fixture of the press which is complemental to the inverted backing sheet into intimate pressure contact with the backing sheet; and, h) applying heat and pressure to the regions of the backing sheet and the blister pack cover which are in face-to-face contact at discrete spaced points so as to cause discrete spaced heated spot bonds between the backing sheet and the blister pack cover in multiple planes where the backing sheet and blister pack cover are in face-to-face contact.

2. The method as set forth in claim 1 wherein the backing sheet is folded about at least three (3) score lines adjacent the at least one (1) die-cut edge during step (b) including folding the backing sheet upwardly out of the plane thereof about a first of the three (3) score lines and through an included angle $\alpha$ with the backing sheet, folding the upwardly folded portion laterally about a second of the three (3) score lines through an included angle $\beta$ with. respect to the upwardly folded portion, and folding the laterally folded portion downwardly about a third of the three (3) score lines through an included angle $\Theta$ with respect to the laterally folded portion so as to form at least one (1) hollow channel-shaped projection extending out of the plane of the backing sheet.

3. The method as set forth in claim 2 wherein the included angles $\alpha$, $\beta$ and $\Theta$ are in the range of from about 30° to about 160° .

4. The method as set forth in claim 2 wherein the included angles $\alpha$ and $\beta$ are on the order of about 105° and the included angle $\Theta$ is on the order of about 100°.

5. The method as set forth in claim 2 wherein the included angles $\alpha$, $\beta$ and $\Theta$ are selected such that the width of the hollow channel-shaped projection at its crest defined by the laterally folded portion is approximately twice the width of the channel-shaped projection as measured in the plane of the backing sheet.

6. The method as set forth in claim 2 wherein the planar sheet of backing material has at least one face thereof bearing thereon preprinted advertising, promotional material and similar product information so that upon formation of the at least one (1) folded hollow channel-shaped projection such printed advertising, promotional material and product information is present on multiple planes including the plane of the backing sheet and the planes contained the upwardly, laterally and downwardly folded portions thereof defining each hollow channel-shaped projection.

7. The method as set forth in claim 6 wherein at least the preprinted surface(s) of the backing sheet are coated with a clear solvent-based plastic coating.

8. The method of forming a blister package containing product(s) to be packaged for delivery to consumers, the method comprising the steps of:

a) forming a thin backing sheet of fibrous material having a planar region and peripheral lineal edges;

b) folding the backing sheet along at least one of the peripheral lineal edges upwardly out of the plane of the sheet through an included angle α with the plane of the backing sheet about a first score line located along and inboard of at least one (1) of the peripheral lineal edges of the sheet;

c) folding the upwardly folded edge portion(s) of the backing sheet laterally through an included angle β with each upwardly folded portion folded during step (b) along a second score line located intermediate the first score line(s) and each of the at least one (1) peripheral lineal edges of the sheet;

d) folding the laterally folded edge portion(s) of the backing sheet downwardly through an included angle β with each laterally folded portion folded during step c) along a third score line located intermediate the second score line(s) and each of the at least one (1) peripheral lineal edges of the backing sheet to form at least one (1) hollow channel-shaped projection along at least one (1) of the peripheral lineal edges of the backing sheet with the hollow channel-shaped projection(s) extending upwardly out of the plane of the backing sheet;

e) forming a vacuum-formed blister pack cover from a sheet of clear plastic material with the cover having at least one downwardly facing vacuum-formed pocket or compartment suitable for reception and containment of the product(s) to be packaged, a planar region surrounding the pocket(s) or compartment(s) formed thereon, and at least one (1) vacuum-formed hollow channel-shaped projection complemental in shape, number and location to the channel-shaped projection(s) formed on the backing sheet;

f) inverting the blister pack cover and placing the inverted cover in a complementally shaped female fixture of a press with the pocket(s) or compartment(s) formed therein facing upward;

g) positioning the product(s) to be packaged in the upwardly facing pocket(s) or compartment(s) in the inverted blister pack cover;

h) inverting the folded backing sheet formed in steps (a), (b), (c), and (d), and placing the inverted backing sheet on the inverted blister pack cover with the folded channel-shaped projection(s) formed on the backing sheet nested within and in face-to-face contact with the inner surfaces of the vacuum-formed channel-shaped projection(s) on the blister pack cover and with the planar region of the blister pack cover surrounding the pocket(s) or compartment(s) formed therein being in face-to-face contact with the planar region of the backing sheet;

i) shifting a male fixture of the press which is complemental to the inverted backing sheet into intimate pressure contact with the backing sheet; and, j) applying heat and pressure to the regions of the backing sheet and the blister pack cover which are in face-to-face contact at discrete spaced points so as to cause discrete spaced heated spot bonds between the backing sheet and the blister pack cover in multiple planes where the backing sheet and blister pack cover are in face-to-face contact.

9. The method as set forth in claim 8 wherein the peripheral lineal edges on the thin backing sheet formed in step (a) include a top edge, a bottom edge, and at least two (2) opposed longitudinal edges, and first and second series of three (3) spaced score lines are formed adjacent and inboard of at least each of the two (2) opposed longitudinal edges of the backing sheet so that upon folding of the backing sheet in steps (b), (c) and (d), two (2) hollow channel-shaped projections are formed along respective different ones of the two (2) opposed longitudinal edges of the backing sheet.

10. The method as set forth in claim 9 wherein the included angles α, β and Θ are in the range of from about 30° to about 160°.

11. The method as set forth in claim 9 wherein the included angles α and β are on the order of about 105° and the included angle Θ is on the order of about 100°.

12. The method as set forth in claim 9 wherein the included angles α, β and Θ are selected such that the width of each of the two (2) hollow channel-shaped projections at its crest defined by the laterally folded portion is approximately twice the width of each channel-shaped projection as measured in the plane of the backing sheet.

13. The method as set forth in claim 9 wherein the planar sheet of backing material has at least one face thereof bearing thereon preprinted advertising, promotional material and similar product information so that upon formation of the folded hollow channel-shaped projections such printed advertising, promotional material and product information is present on multiple planes including the plane of the backing sheet and the planes containing the upwardly, laterally and downwardly folded portions thereof defining the two (2) hollow channel-shaped projections.

14. The method as set forth in claim 13 wherein at least the preprinted surface(s) of the backing sheet are coated with a clear solvent-based plastic coating.

15. The method as set forth in claim 9 wherein the first score line in each of the first and second series of three (3) spaced score lines converges toward the second score line, the second and third score lines in each of the first and second series of score lines are parallel, and the adjacent ones of the opposed longitudinal edges converge towards respective ones of the third score line adjacent the opposed longitudinal edges so that the two (2) hollow channel-shaped projections formed along the opposed longitudinal edges of the backing sheet taper from a maximum height adjacent one of the top and bottom edges of the backing sheet toward a minimum height adjacent the other of the top and bottom edges of the backing sheet.

16. The method as set forth in claim 8 wherein the peripheral lineal edges on the backing sheet formed in step (a) include a top edge, a bottom edge and at least two (2) opposed longitudinal edges, first and second series of three (3) spaced score lines are formed adjacent and inboard of the at least two (2) opposed longitudinal edges of the backing sheet, and a third series of three (3) spaced score lines are formed adjacent and inboard at least one of the top and bottom edges of the backing sheet so that upon folding of the backing sheet in steps (b), (c) and (d), two (2) hollow channel-shaped projections are formed along respective different ones of the at least two (2) opposed longitudinal edges of the backing sheet and at least one (1) hollow, channel-shaped projection is formed along at least one of the top and bottom edges of the backing sheet.

17. The method as set forth in claim 16 wherein the included angles α, β and Θ are in the range of from about 30° to about 160°.

18. The method as set forth in claim 16 wherein the included angles α and β are about 105° and the included angle Θ is about 100°.

19. The method as set forth in claim 16 wherein the included angles α, β and Θ are selected such that the width of each hollow channel-shaped projection at its crest defined by the laterally folded portion is approximately twice the width of each channel-shaped projection as measured in the plane of the backing sheet.

20. The method as set forth in claim 16 wherein the planar sheet of backing material has at least one face thereof bearing thereon preprinted advertising, promotional material and similar product information so that upon formation of the folded hollow channel-shaped projections such printed advertising, promotional material and product information is present on multiple planes including the plane of the backing sheet and the planes containing the upwardly, laterally and downwardly folded portions thereof defining each of the hollow channel-shaped projections.

21. The method as set forth in claim 20 wherein at least the preprinted surface(s) of the backing sheet are coated with a clear solvent-based plastic coating.

* * * * *